US007638918B2

(12) United States Patent
Uecker

(10) Patent No.: US 7,638,918 B2
(45) Date of Patent: Dec. 29, 2009

(54) CARBON BRUSH HAVING A SHUNT WIRE IN A CARBON BRUSH BODY

(75) Inventor: Arwed Uecker, Farmville, VA (US)

(73) Assignee: Carbone Lorraine Applications Electriques, Amiens (FR)

( * ) Notice: Subject to any disclaimer, the term of this patent is extended or adjusted under 35 U.S.C. 154(b) by 555 days.

(21) Appl. No.: 11/140,986

(22) Filed: Jun. 1, 2005

(65) Prior Publication Data

US 2005/0274006 A1 Dec. 15, 2005

(51) Int. Cl.
*H01R 39/36* (2006.01)

(52) U.S. Cl. ..... 310/249; 310/251; 310/252; 310/253

(58) Field of Classification Search ..... 310/249, 310/251, 252, 253
See application file for complete search history.

(56) References Cited

U.S. PATENT DOCUMENTS

| | | | | | |
|---|---|---|---|---|---|
| 1,485,942 | A | * | 3/1924 | Adams | 310/249 |
| 1,959,848 | A | * | 5/1934 | Abbott | 310/249 |
| 2,092,627 | A | * | 9/1937 | Adams | 310/249 |
| 2,631,252 | A | * | 3/1953 | Falcettoni | 310/249 |
| 2,849,631 | A | * | 8/1958 | Matz | 310/249 |
| 2,866,112 | A | * | 12/1958 | Matz | 310/249 |
| 3,064,151 | A | * | 11/1962 | Rusynyk | 310/249 |
| 3,173,047 | A | * | 3/1965 | Matz | 310/249 |
| 4,075,524 | A | * | 2/1978 | Bradshaw et al. | 310/249 |
| 4,536,670 | A | * | 8/1985 | Mayer | 310/249 |
| 4,579,611 | A | | 4/1986 | Broady | |
| 5,441,683 | A | | 8/1995 | Kammerer et al. | |
| 5,701,046 | A | | 12/1997 | Kammerer et al. | |
| 5,744,892 | A | * | 4/1998 | Mukai et al. | 310/251 |
| 5,763,082 | A | * | 6/1998 | Kokumai et al. | 428/402 |
| 2003/0090166 | A1 | * | 5/2003 | Kobayashi et al. | 310/144 |

FOREIGN PATENT DOCUMENTS

| | | |
|---|---|---|
| DE | 19900024 | 7/2000 |

OTHER PUBLICATIONS

English Abstract of DE 19900024 A1 (Boettger et al., Jul. 6, 2000).*

* cited by examiner

*Primary Examiner*—Quyen Leung
*Assistant Examiner*—Alex W Mok
(74) *Attorney, Agent, or Firm*—Dennison, Shultz & MacDonald

(57) ABSTRACT

In a process for attaching a shunt wire to a carbon brush body in which a resin-containing cement is tamped into a cavity in the brush body, an improved cement is used, formed from a mixture of polyphenylene sulfide powder having a grain size of 5 to 50 μm and copper-based powder. The brush produced thereby is improved in resistance to alcohol-containing fuels.

14 Claims, 2 Drawing Sheets

CARBON BRUSH HAVING A SHUNT WIRE IN A CARBON BRUSH BODY

BACKGROUND OF THE INVENTION

This invention relates to carbon brushes, and in particular, a method for attaching a shunt wire to a brush body, an improved cement for attaching a shunt wire to a brush body, and the brush obtained using this cement.

In the production of carbon brushes for electrical motors, it is well known to attach a shunt wire to a brush body by tamping. In this process, known for example from U.S. Pat. No. 4,579,611, a cement mixture containing a conductive powder and a thermosetting resin is tamped around a shunt wire. Subsequently, the resin may be cured by heating or by a chemical reaction. The resin enhances the stability and integrity of the tamping connection. Presently, these resins are mostly phenolic resins. While polyimides have also been used, they are undesirable from an environmental point of view.

Tamped brushes that are used in fuel pumps, particularly for automotive applications, are often exposed to the fuel that the pump is conveying. As more cars are being fueled with gasoline that contains various additives and alcohol, the long term stability of the tamping cement is no longer guaranteed, as the alcohol and additives tend to cause deterioration of the resin in the cement. This deterioration manifests itself in increased resistance between the shunt wire and the brush.

It is also known to produce tamped brushed from silver-plated copper powder without resin. Such brushes are extremely stable in alcohol-based fuels, but the pull out force is relatively low, especially in shallow tamp holes, as these brushes rely solely on mechanical deformations and stress forces in the copper powder to keep the shunt secured in place.

SUMMARY OF THE INVENTION

It is an object of the invention to provide electrical brushes suitable for use in corrosive fuels which do not exhibit increase resistance when exposed to the fuel.

It is a further object of the invention to provide electrical brushes of increased resistance to physical deterioration when exposed to corrosive fuels.

In order to achieve these and other objects, the invention proposes the use of a tamping cement formed from a copper based electrically conductive powder in combination with very fine polyphenylene sulfide (PPS) powder as the resin additive. PPS enhances the strength and seals the connection as other resins do, but is inherently stable in all known additives and alcohols and therefore solves the problem of increases in resistance over the lifetime of the motor.

DESCRIPTION OF THE PREFERRED EMBODIMENTS

Poly(p-phenylene sulfide) (PPS) is a polymer made up of alternating sulfur atoms and phenylene rings in a para substitution pattern. The highly stable chemical bonds of its molecular structure impart molecular stability toward both thermal degradation and chemical reactivity. Because of its molecular structure, PPS also tends to char during combustion, making the material inherently flame retardant. PPS has not been found to dissolve in any solvent at temperatures below about 200° C.

The PPS powder useful in the invention generally has a particle size of 5 to 50 μm. PPS of this particle size is known for formation of brush bodies, from DE 199 00 024 A1, and is available commercially under the trademark "Ryton" from Chevron-Phillips Chemicals International N.V. In prior art brush formation, the PPS has been combined with graphite, compressed, granulated and recompressed, then cured at 275-350° C.

According to the invention, a cement is formed containing a copper powder of particle size preferably in the range of 25-150 μm, although a coarser powder of size range 75-250 μm may also be used. The copper powder may be plated, for example with silver or tin, as are commonly used in the art. Other metal plated copper powders are also acceptable.

The cement contains PPS powder in an amount of 0.5-6 weight %, and preferably 2-4 weight %, in combination with the aforementioned copper powder. Generally, the finer the copper powder used, the greater the amount of resin that is required.

The process for attaching the shunt wire to the brush body is shown in FIGS. 1*a*-1*d*.

Figure 1A:
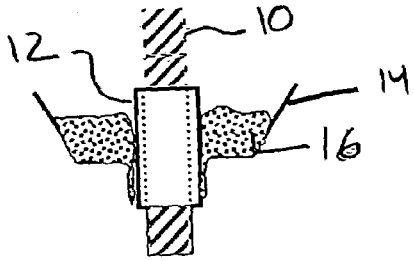
FIGS. 1*a*-1*d* are schematic diagrams of the steps of forming a brush according to the invention.
Figure 1B:
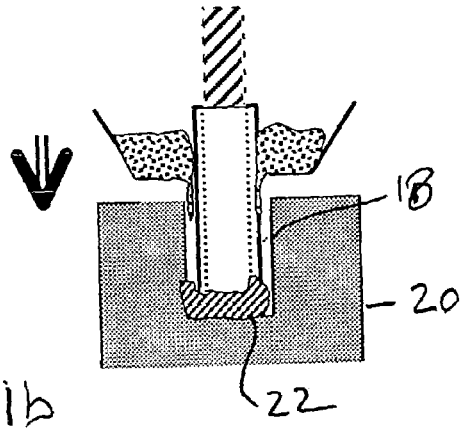

Initially, as shown in FIG. 1*a*, the shunt wire 10 passes through a tamping needle 12, which passes though a cup 14 containing the cement mixture of the invention 16.

Figure 1C:
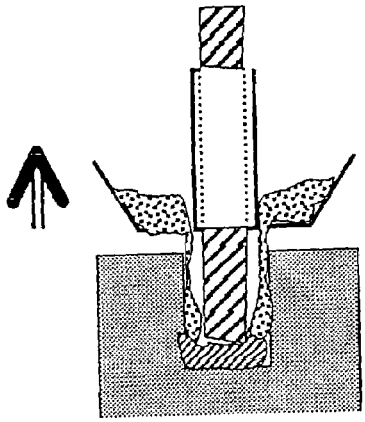
Figure 1D:
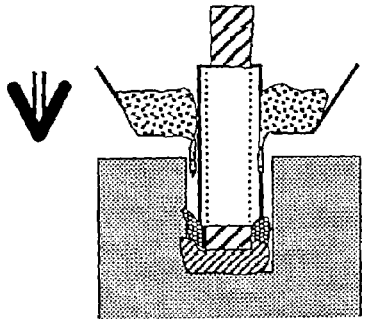
Figure 2:
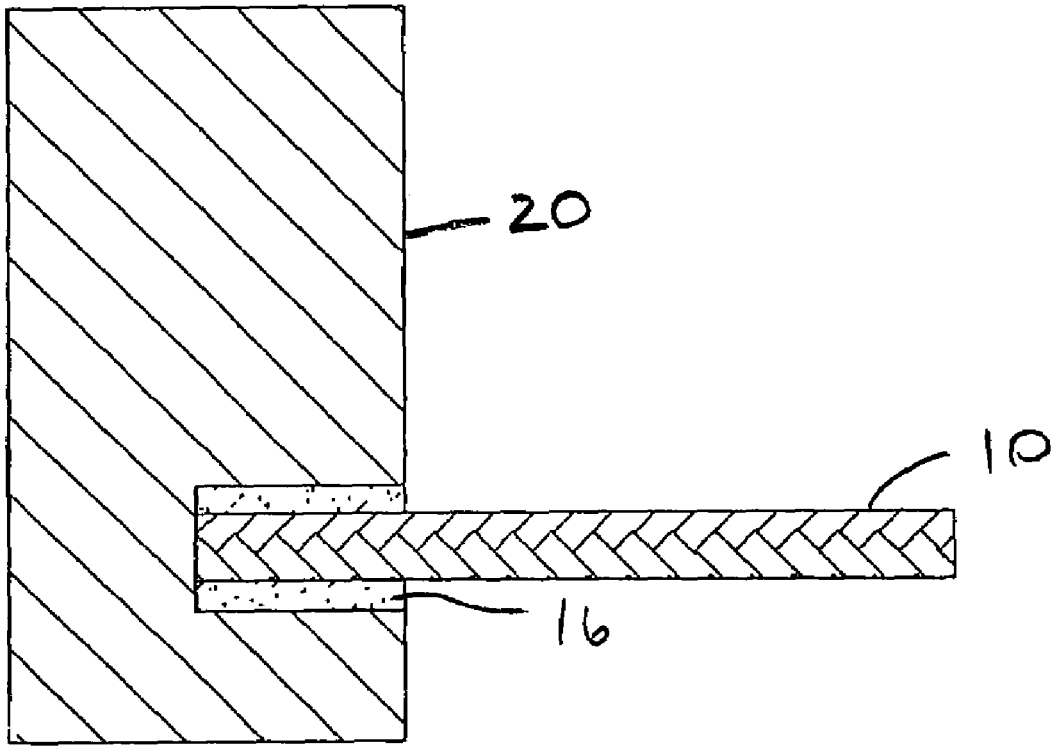
FIG. 2 is a cross-sectional diagram of a brush according to the invention.

This structure is lowered such that the tamping needle 12 passes into a cavity 18 in brush body 20. A knot 22 is initially formed in the wire to retain the wire in the body. The needle then is raised as shown in FIG. 1*c*, allowing the cement 16 to fall into the cavity around the wire. Then, the needle is lowered as shown in FIG. 1*d* to tamp the cement. The raising and lowering is repeated typically 6-7 times, until the cement rises to the desired height. The final product is shown in FIG. 2.

Preferably, the brush body may be heated to about 275-350° C. after tamping is complete to melt and fuse the thermoplastic PPS powder, allowing it to flow into crevices in the body, and increase the retention strength of the shunt wire in the cavity. The heating time necessary at the melting temperature of the PPS powder to fully cure the resin is about 10-20 minutes, preferably about 15 minutes, although the complete time for a cycle of furnace heating, melting and cooling is about 1 hours. Moreover, it is possible to partially cure the PPS resin by heating to a lower temperature, for example about 150° C., for a longer period, for example, about 1-3 hours.

EXAMPLES

Example 1

Deterioration of the shunt connection for various tamping cements and various fuels was determined as follows:

Brushes according to the invention were produced with 3% by weight PPS, remainder silver plated copper powder (25-150 μm) cement and a nickel-plated shunt wire. Some samples were uncured, some samples were undercured at 150° C. for 2 hours, and some samples were cured normally at 290° C. for 30 minutes in a belt furnace.

Comparative samples were prepared from silver plated copper filler (no additives), silver plated copper with a cyanoacrylate adhesive gluing the shunt to the copper powder, and silver plated copper powder with phenolic resin (current standard cement) cured to harden the resin.

Each brush type was exposed to three test fuels for periods of up to 500 hours. The test fuels were:

1) corrosive fuel, containing, by weight, 22% ethanol, 77% gasoline and 1% corrosive water containing 33 mg/l sodium sulfate, 33 mg/l sodium chloride and 33 mg/l acetic acid in distilled water;

2) sulfur-containing fuel, containing 20 mg/l sulfur in gasoline; and 3) corrosive two phase fuel, containing, by weight, 10% ethanol, 43.75% toluene, 43.75% iso-octane and 2.5% corrosive water containing 148 mg/l sodium sulfate and 165 mg/l sodium chloride in distilled water).

The brushes were tested by connecting the shunt and brush in a direct current circuit at 1 ampere, with stainless steel contacts on the brush portion and the shunt portion connected to a voltmeter to measure the voltage drop at the shunt/brush junction. A measurement of the voltage drop for each brush was made before soaking in fuel, and then measurements were made at 50, 100 and 500 hours.

30 pieces of each sample were soaked in a fuel at 60° C. Test results were as follows, with voltage drop reported in millivolts):

| Fuel type | Hours | Invention (uncured) Silver plated copper w/phenolic | Invention (under-cured) Silver plated copper w/phenolic | Invention (fully cured) Silver plated copper w/phenolic | Silver plated copper | Silver plated copper with glue | Silver plated copper with phenolic |
|---|---|---|---|---|---|---|---|
| corr. | 0 | 1.30 | 1.34 | 1.73 | 1.34 | 1.54 | 4.91 |
| | 50 | 1.24 | 1.43 | 1.80 | 1.37 | 2.17 | 9.37 |
| | 100 | 1.27 | 1.52 | 1.73 | 1.42 | 2.09 | 11.35 |
| | 500 | 1.23 | 1.40 | 1.93 | 1.51 | 2.61 | 13.46 |
| sulfur | 0 | 1.27 | 1.52 | 1.66 | 1.36 | 1.58 | 5.58 |
| | 50 | 1.37 | 1.78 | 1.93 | 1.82 | 2.12 | 6.81 |
| | 100 | 1.16 | 1.75 | 2.05 | 2.10 | 2.12 | 9.87 |
| | 50 | 1.56 | 1.96 | 2.24 | 2.45 | 2.69 | 10.68 |
| corr. 2-phase | 0 | 1.29 | 1.43 | 1.64 | 1.42 | 1.69 | 5.35 |
| | 50 | 1.71 | 1.94 | 2.49 | 2.22 | 2.87 | 17.05 |
| | 100 | 1.87 | 2.05 | 2.58 | 2.35 | 3.07 | 20.30 |
| | 500 | 2.38 | 2.77 | 3.19 | 3.49 | 3.47 | 22.22 |

The largest voltage drops were observed for all fuels with the prior art cement containing phenolic, which is known to degrade with exposure to fuel. The smallest voltage drops were observed with uncured PPS-based cement.

Example 2

Brush samples prepared as in Example 1 were used to test the the force necessary to pull out the shunt wire, initially and after soaking for 500 hours in a designated fuel. Thirty samples of each brush were tested.

Average pull out force in Newtons was determined for each brush. Results are in the table below (including standard deviation):

| Soak | Ag-plated copper | Ag-plated copper w/glue | Invention uncured | Invention undercured | Invention fully cured | Ag-plated copper w/phenolic |
|---|---|---|---|---|---|---|
| not soaked | 29.0 ± 8.7 | 46.3 ± 11.8 | 48.8 ± 6.8 | 49.4 ± 8.5 | 61.9 ± 10.9 | 54.4 ± 23.0 |
| 500 hours corrosive fuel | 37.05 ± 5.9 | 32.25 ± 8.5 | 63.3 ± 7.4 | 58.15 ± 10.9 | 70.9 ± 8.4 | 60.1 ± 19.5 |
| 500 hours sulfur fuel | 35.75 ± 10.0 | 34.8 ± 8.2 | 62 ± 11.4 | 60.6 ± 8.7 | 67 ± 7.5 | 60 ± 22 |
| 500 hours 2-phase corrosive fuel | 45.3 ± 8.15 | 40.45 ± 10.6 | 69.35 ± 10.7 | 78.95 ± 6.2 | 82.05 ± 8.2 | 59.55 ± 17.9 |

In all cases except the copper powder with glue, the pull force actually increased with soaking in fuel. This is thought to be due to swelling of the cement.

The best results were obtained with the cements according to the invention, and the best results among these were with the fully cured cement.

It can be seen from the above results that the use of the cement of the invention provides the best combination of properties, with the least deterioration in the electrical properties and the greatest stability in the physical junction.

What is claimed is:

1. A carbon brush comprising a carbon brush body having a cavity therein and a shunt wire retained in and extending from the cavity, the shunt wire being retained in the body by a cement comprising a mixture of 0.5-6 weight % polyphenylene sulfide powder having a grain size of 5 to 50 μm and, remainder, substantially a copper-based powder.

2. The brush of claim 1, wherein the cement comprises 2-4 weight % of the polyphenylene sulfide powder.

3. The brush of claim 1, wherein the cement comprises a fused mixture of said polyphenylene sulfide powder and said copper-based powder.

4. The brush of claim 1, wherein the copper-based powder has a particle size range of about 25-150 μm.

5. The brush of claim 1, wherein the copper-based powder comprises copper powder, silver-plated copper powder or tin-plated copper powder.

6. The brush of claim 1, wherein the cement comprises a fully cured mixture of said polyphenylene sulfide powder and said copper-based powder.

7. The brush of claim 1, wherein the cement comprises a partially cured mixture of said polyphenylene sulfide powder and said copper-based powder.

8. A cement for retaining a shunt wire in a cavity of a carbon brush, comprising a mixture of 0.5-6 weight % polyphenylene sulfide powder having a grain size of 5 to 50 μm and, remainder, substantially a copper-based powder.

9. The cement of claim 8, wherein the cement comprises 2-4 weight % of the polyphenylene sulfide powder.

10. The cement of claim 8, wherein the copper-based powder has a particle size range of about 25-150 μm.

11. The cement of claim 8, wherein the copper-based powder comprises copper powder, silver-plated copper powder or tin-plated copper powder.

12. The cement of claim 8, wherein the cement has been fully cured by heating said mixture of said polyphenylene sulfide powder and said copper-based powder.

13. The cement of claim 8, wherein the cement has been partially cured by heating said mixture of said polyphenylene sulfide powder and said copper-based powder to a temperature below the polyphenylene sulfide melting temperature.

14. In a fuel pump, the improvement comprising a fuel resistant carbon electrical brush comprising a carbon brush body having a cavity therein and a shunt wire retained in and extending from the cavity, the shunt wire being retained in the body by a cement comprising a mixture of 0.5-6 weight % polyphenylene sulfide powder having a grain size of 5 to 50 μm and, remainder, substantially a copper-based powder.

* * * * *

UNITED STATES PATENT AND TRADEMARK OFFICE

CERTIFICATE OF CORRECTION

PATENT NO. : 7,638,918 B2
APPLICATION NO. : 11/140986
DATED : December 29, 2009
INVENTOR(S) : Arwed Uecker It is certified that error appears in the above-identified patent and that said Letters Patent is hereby corrected as shown below:

Title Page, insert:

--Related U.S. Application Data
(60) Provisional application No. 60/578,819, June 14, 2004.--

Column 1, after the title, insert:

--The present application claims the benefit of U.S. provisional application 60/578,819, filed June 14, 2004.--

Signed and Sealed this

Thirteenth Day of April, 2010

David J. Kappos

David J. Kappos
*Director of the United States Patent and Trademark Office*